US007393499B2

(12) United States Patent
Sugahara

(10) Patent No.: US 7,393,499 B2
(45) Date of Patent: Jul. 1, 2008

(54) NI ALLOY ANODE MATERIAL FOR NI ELECTROPLATING

(75) Inventor: Katsuo Sugahara, Saitama (JP)

(73) Assignee: Mitsubishi Materials Corporation, Chiyoda-Ku, Tokyo (JP)

( * ) Notice: Subject to any disclaimer, the term of this patent is extended or adjusted under 35 U.S.C. 154(b) by 472 days.

(21) Appl. No.: 10/546,087

(22) PCT Filed: Feb. 21, 2003

(86) PCT No.: PCT/JP03/01936

§ 371 (c)(1),
(2), (4) Date: Aug. 16, 2005

(87) PCT Pub. No.: WO2004/074555

PCT Pub. Date: Sep. 2, 2004

(65) Prior Publication Data

US 2006/0147336 A1 Jul. 6, 2006

(51) Int. Cl.
*C22C 19/03* (2006.01)

(52) U.S. Cl. ..... 420/460; 148/426

(58) Field of Classification Search ..... 148/426; 420/460

See application file for complete search history.

(56) References Cited

FOREIGN PATENT DOCUMENTS

| | | |
|---|---|---|
| JP | 04-099198 | 3/1992 |
| JP | 2003-064437 | 3/2003 |

*Primary Examiner*—John P. Sheehan
*Assistant Examiner*—Jessee Roe
(74) *Attorney, Agent, or Firm*—Darby & Darby P.C.

(57) ABSTRACT

The invention relates to a Ni alloy anode material for Ni electroplating, which exhibits high plating yield. The Ni alloy anode material comprises a Ni alloy consisting essentially of high-purity Ni having purity of 99.99 mass % or higher and, as an alloy component, Si and Al in the following contents: Si: 30 to 300 ppm, and Al: 30 to 300 ppm.

2 Claims, No Drawings

NI ALLOY ANODE MATERIAL FOR NI ELECTROPLATING

TECHNICAL FIELD

The present invention relates to a Ni alloy anode material, which contributes to factory automation (FA) of an electroplating equipment and enables cost reduction, because it enables high plating yield, that is, prolongation of service life in case of a Ni electroplating treatment thereby to reduce the number of replacement of the anode material.

BACKGROUND ART

It is indispensable to form a high-purity Ni thin film so as to produce a semiconductor device, lately. The high-purity Ni thin film is formed by an electroplating method using Ni having high purity of 99.99% by mass or higher as an anode material.

In view of factory automation of an electroplating equipment and cost reduction of formation of a high-purity Ni thin film, improvement in plating yield, that is, further prolongation of service life as well as improvement in the proportion of formation of the high-purity Ni thin film per one high-purity Ni anode material are always required to the high-purity Ni anode material at present.

DISCLOSURE OF THE INVENTION

Under these circumstances, the present inventors have intensively studied so as to improve plating yield of the above high-purity Ni anode material for Ni electroplating, thus resulting in the following findings. (a) In a Ni electroplating treatment, a load voltage is controlled so that a fixed current of 2 A/dm$^2$ always flows in a high-purity Ni anode material so as to keep a rate of elution of Ni from the anode material in an electrolytic solution constant. Therefore, the load voltage increases corresponding to surface properties which vary depending on elution of Ni from the electrode material and, for example, it is defined that service life of the electrode material has expired when an initial load voltage of 1.3 V (5 minutes after starting of plating) has increased to about 2.5 V.

(b) Elution of Ni from the anode material proceeds in a dendritic form and the anode material is finally converted into a spongy form. For example, the load voltage of about 2.5 V exhibits a spongy form of the electrode material and it is defined that service life of the electrode material has expired at this time. This reason is considered as follows. That is, when a plating treatment is further continued, the load voltage rapidly increases and hydrolysis occurs on the surface to be plated, as a cathode. Among hydrogen and oxygen generated as a result of hydrolysis, hydrogen is caught in a Ni plating thin film and exists in the form of pinholes, and thus properties of the thin film are drastically deteriorated.

(c) The use of a Ni alloy consisting essentially, in % by mass, of 30 to 300 ppm of Si, 30 to 300 ppm of Al with a balance of Ni and inevitable impurities as an anode material for Ni electroplating makes the form of elution of Ni from the anode material in the Ni electroplating treatment, that is, a dendritic elution form at an initial stage of Ni electroplating and a spongy elution form at a final stage fine. Consequently, an increase of the load voltage in the anode material is remarkably suppressed and it becomes possible to perform a plating treatment for relatively long time, and thus plating yield is improved and throughput on plating per electrode material relatively increases.

The present invention has been completed based on the above findings.

In an aspect, the Ni alloy anode material for Ni electroplating, which exhibits high plating yield, of the present invention consists essentially, in % by mass, of 30 to 300 ppm of Si, 30 to 300 ppm of Al with a balance of Ni and inevitable impurities.

In another aspect, the Ni alloy anode material for Ni electroplating, which exhibits high plating yield, of the present invention comprises a high-purity Ni alloy, said Ni alloy consisting essentially of high-purity Ni having purity of 99.99% by mass or higher and, as an alloy component, Si and Al in the following contents:

Si: 30 to 300 ppm, and

Al: 30 to 300 ppm.

In the Ni alloy constituting the Ni alloy anode material of the present invention, Si and Al exert the effect of making an elution form of the electrode material in the electroplating treatment remarkably fine in a coexisting state described above, thereby to suppress an increase of the voltage and to prolong service life. Therefore, when the Ni alloy contains only Si or Al or the content of any one of them is less than 30 ppm even if both of them are contained, the desired effect can not be exerted. On the other hand, when the content of Si or Al exceeds 300 ppm, elution of Ni into an electrolytic solution from the surface of the anode material is suppressed and a plating voltage increases, and thus service life relatively decreases, that is, plating yield decreases. Therefore, each content was defined as follows: Si: 30 to 300 ppm and Al: 30 to 300 ppm.

BEST MODE FOR CARRYING OUT THE INVENTION

The Ni alloy anode material of the present invention will now be described in detail by way of examples.

Each of Ni alloy anode materials of the present invention (hereinafter referred to as anode materials of the present invention) 1 to 14 having Si and Al contents shown in Table 1 was produced by vacuum-melting high-purity Ni having purity shown in Table 1 in an electrically heated melting crucible, adding Si and Al in a predetermined amount within a range from 30 to 300 ppm in the form of a Ni-Si alloy and a Ni-Al alloy to obtain a molten high-purity Ni alloy, casting the alloy into an ingot having a diameter of 100 mm and a length of 120 mm, subjecting the ingot to hot forging at a temperature of 1100° C. to form a plate having a width of 125 mm and a thickness of 23 mm, subjecting the plate to cold rolling to form a cold rolled plate having a width of 125 mm and a thickness of 10 mm, subjecting the cold rolled plate to a recrystallizing heat treatment at a temperature within a range from 450 to 750° C. for one hour, thereby to adjust to an average grain size shown in Table 1, cutting the plate to form a plate having a length of 100 mm, a width of 50 mm and a thickness of 10 mm, and facing the plate to form a plate having a thickness of 7.5 mm.

For comparison, comparative Ni alloy anode materials (hereinafter referred to as comparative anode materials) 1 to 6 were produced under the same conditions except that the content of at least one of Si and Al fall outside the scope of the present invention as shown in Table 1.

To examine an influence of purity, conventional Ni alloy anode materials (hereinafter referred to as conventional anode materials) 1 to 2 were produced from commercially available 10 mm thick 99.9% Ni plate and 99.99% Ni plate in the same manner.

The resulting anode materials 1 to 14 of the present invention, comparative anode materials 1 to 6 and conventional anode materials 1 to 2 were placed in an electroplating bath with a stirring blade after being degreased and pickled, and then subjected to a plating test wherein the surface of the cathode material is Ni-plated under the following conditions:

Cathode material: oxygen-free copper,

Electrolytic solution: sulfamic acid solution having pH of 4.0, containing 5 g/l of nickel chloride, 350 g/l of nickel sulfamate, 40 g/l of boric acid and 0.06 g/l of a surfactant, Temperature of electrolytic solution: 55° C., and Current density: 2 A/dm$^2$.

The plating time required to increase the nominal voltage during plating to 2.5 V (nominal voltage of 2.5 V is the voltage at which hydrolysis occurs on the surface of the cathode material) was measured.

TABLE 1

| Type | | Purity of high-purity Ni (% by mass) | Si content (ppm) | Al content (ppm) | Average grain size (·m) | Plating time (Hours) |
|---|---|---|---|---|---|---|
| Anode materials of the present invention | 1 | 99.996 | 40.7 | 148.5 | 23.4 | 69.3 |
| | 2 | 99.995 | 70.1 | 187.2 | 21.3 | 71.4 |
| | 3 | 99.994 | 149.1 | 150.2 | 15.6 | 75.2 |
| | 4 | 99.993 | 201.3 | 148.9 | 23.7 | 74.7 |
| | 5 | 99.995 | 250.8 | 151.4 | 24.0 | 72.1 |
| | 6 | 99.992 | 296.9 | 150.6 | 30.7 | 64.4 |
| | 7 | 99.996 | 148.8 | 40.2 | 32.2 | 63.0 |
| | 8 | 99.994 | 150.5 | 101.3 | 20.2 | 70.2 |
| | 9 | 99.996 | 147.9 | 150.4 | 80.6 | 64.1 |
| | 10 | 99.992 | 150.3 | 200.8 | 28.9 | 67.0 |
| | 11 | 99.995 | 146.7 | 251.8 | 42.6 | 66.8 |
| | 12 | 99.992 | 150.3 | 298.7 | 50.3 | 63.7 |
| | 13 | 99.994 | 31.2 | 60.3 | 25.4 | 66.2 |
| | 14 | 99.995 | 72.1 | 32.0 | 33.6 | 64.9 |
| Comparative anode materials | 1 | 99.992 | 21.7* | 148.0 | 26.5 | 59.4 |
| | 2 | 99.987 | 346.2* | 149.3 | 30.3 | 58.8 |
| | 3 | 99.996 | 25.5* | 21.5* | 22.3 | 59.1 |
| | 4 | 99.993 | 149.0 | 20.4* | 31.6 | 57.2 |
| | 5 | 99.985 | 150.1 | 350.6* | 27.8 | 58.4 |
| | 6 | 99.981 | 348.5* | 351.9* | 26.9 | 55.3 |
| Conventional anode materials | 1 | 99.97 | 0.1 | 0.1 | 25.6 | 53.2 |
| | 2 | 99.99 | 0.1 | 0.2 | 28.8 | 56.1 |

In the table, the symbol * represents the content which falls outside the scope of the invention.

INDUSTRIAL APPLICABILITY

As is apparent from the results shown in Table 1, the anode materials 1 to 14 of the present invention, wherein both Si and Al contents are within a range from 30 to 300 ppm, exhibit long plating time regardless of an average particle size and this fact means that the anode material exhibits high plating yield in case of a Ni electroplating treatment. On the other hand, when the content of at least one of Si and Al falls outside the scope of the present invention as shown in comparative anode materials 1 to 6, the plating time relatively decreases and thus it is difficult to improve plating yield of the anode material. Also when both Si and Al contents are too small as shown in conventional anode materials 1 to 2, the plating time relatively decreases and thus it is difficult to improve plating yield of the anode material.

As described above, the Ni alloy anode material of the present invention contributes to factory automation of an electroplating equipment and enables cost reduction thereby to exert industrially useful effects, because it enables high plating yield, that is, prolongation of service life in case of a Ni electroplating treatment thereby to reduce the number of replacement of the anode material.

The invention claimed is:

1. A Ni alloy anode material for Ni electroplating, which exhibits high plating yield, consisting essentially, in % by mass, of 30 to 300 ppm of Si, 30 to 300 ppm of Al with a balance of Ni and inevitable impurities.

2. A Ni alloy anode material for Ni electroplating, which exhibits high plating yield, comprising a high-purity Ni alloy, said Ni alloy consisting essentially of high-purity Ni having purity of 99.99% by mass or higher and, as an alloy component, Si and Al in the following contents:

Si: 30 to 300 ppm, and

Al: 30 to 300 ppm.

* * * * *